United States Patent [19]

Sakakibara

[11] Patent Number: 4,903,076

[45] Date of Patent: Feb. 20, 1990

[54] IMAGE FORMING APPARATUS HAVING STATIONARY UPPER UNIT AND PIVOTABLE LOWER UNIT

[75] Inventor: Katsunori Sakakibara, Osaka, Japan

[73] Assignee: Minolta Camera Kabushiki Kaisha, Osaka, Japan

[21] Appl. No.: 357,718

[22] Filed: May 26, 1989

[30] Foreign Application Priority Data

May 27, 1988 [JP] Japan ..... 63-129990

[51] Int. Cl.[4] ..... G03G 15/00

[52] U.S. Cl. ..... 355/200; 271/162; 271/273; 355/309

[58] Field of Search ..... 271/162, 273, 274; 355/200, 309, 271

[56] References Cited

U.S. PATENT DOCUMENTS 4,431,180 2/1984 Nakajima ..... 271/274
4,570,923 2/1986 Hooper et al. ..... 271/273 X
4,583,844 4/1986 Honda ..... 355/309
4,625,958 12/1986 Dyma et al. ..... 271/274
4,666,284 5/1987 Yamada ..... 355/271
4,784,274 11/1988 Mori et al. ..... 271/273 X

*Primary Examiner*—Arthur T. Grimley
*Assistant Examiner*—Thu Anh Dang
*Attorney, Agent, or Firm*—Burns, Doane, Swecker & Mathis

[57] ABSTRACT

An image forming apparatus of this invention is embodied, for example, in a reader printer. It possesses a stationary upper unit and a lower unit pivotally attached to the rear end part of the upper unit. A paper tray for receiving papers having a transferred image formed thereon is pivotally attached to the leading end of the lower unit. The leading end of the paper tray is slidably supported on the main body of the apparatus. While the lower unit is in the opened state, the leading end part of the tray is positioned at a level higher than the basal end part thereof, with the result that the papers held in the tray are prevented from falling down.

3 Claims, 3 Drawing Sheets

IMAGE FORMING APPARATUS HAVING STATIONARY UPPER UNIT AND PIVOTABLE LOWER UNIT

BACKGROUND OF THE INVENTION

1. Field of the Invention:

This invention relates to an image forming apparatus and more particularly to an image forming apparatus which possesses a stationary upper unit and a pivotable lower unit disposed thereunder as opposed thereto.

2. Related Art of the Invention:

U.S. Pat. No. 4,583,844 discloses an electrophotographic copying maching which possesses a stationary lower unit and a pivotable upper unit disposed thereon as opposed thereto. The idea of a construction capable of being divided into an upper unit and a lower unit with a paper transport path as the boundary in the copying machine mentioned above has been known in the art.

In the copying machine, the upper unit can be pivoted as disclosed in the U.S. patent specification. There are image forming apparatuses such as a reader printer which are constructed so that the upper unit cannot be easily pivoted. In the case of the reader printer, generally a screen is disposed in the upper part of the apparatus and an image forming mechanism in the lower part thereof. When the image forming mechanism is given a construction divisible into an upper unit and a lower unit with a paper transport path as the boundary, the lower unit is desired to be pivoted downwardly because the upper unit is provided thereon with the screen.

FIG. 1 illustrates an image forming apparatus 2 which is so constructed as to be divided into a lower unit 3 and an upper unit 4. When the lower unit 3 is adapted to be pivoted downwardly as illustrated in the diagram, the leading end part 1a of a paper discharge tray 1 disposed in the lower unit 3 falls below the basal end part **1*b* thereof and consequently the upper surface of the paper discharge tray 1 is inclined downwardly by an angle of 74 relative to the horizontal plane H. As the result, papers discharged onto the paper discharge tray 1** are suffered to slip down.

FIG. 2 illustrates a reader printer produced by Canon Inc. and marketed under product code of "PC-80". It uses a paper discharge pocket P in the place of a paper discharge tray. The lower unit 3 is adapted so as to be downwardly pivoted independently of the paper discharge pocket P. The adoption of the paper discharge pocket P, however, entails a disadvantage that papers received in the paper discharge pocket P are liable to bend and are not accommodated therein so neatly as when they are received in th paper discharge tray.

SUMMARY OF THE INVENTION

A main object of this invention, therefore, is to provide an image forming apparatus endowed with a construction such that the apparatus itself is divisible into an upper unit and a lower unit and the lower unit, on being swung to the lower position thereof, does not suffer papers discharged into the paper discharge tray to slip down.

In accordance with one aspect of the invention, there is provided in an image forming apparatus possessing a stationary upper unit and pivotable lower unit adapted to swing downwardly about a pivotal axis attached to the upper unit, the improvement which comprises a paper receiving tray for receiving a paper having a transferred toner image formed thereon, a basal end part of the paper receiving tray being rotatably attached to the lower unit at the side opposite to a pivotal axis of the lower unit so that a leading end part of the paper receiving tray is positioned at a level higher than the basal end part thereof.

DESCRIPTION OF THE PRFERRED EMBODIMENTS

Figure 1:
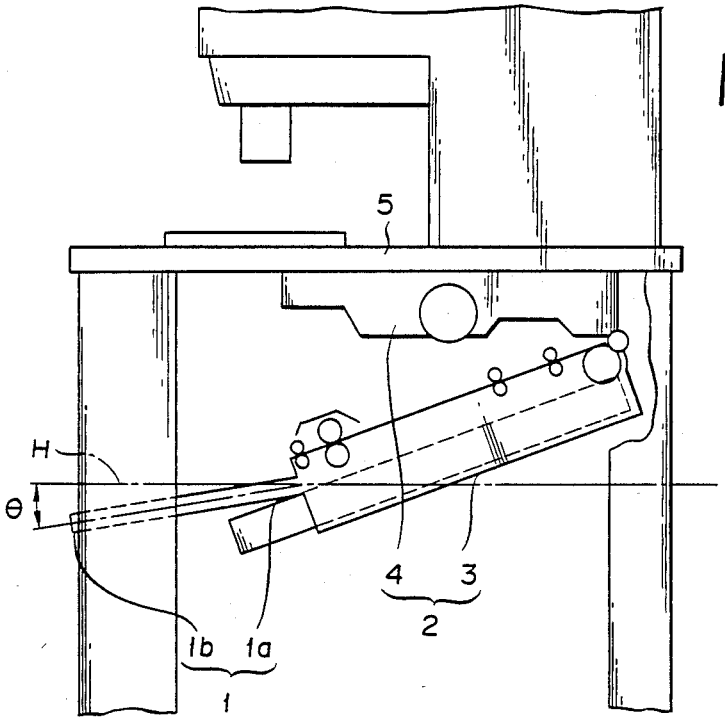
FIG. 1 is a partially omitted side view illustrating an image forming apparatus as depicting related art of the present invention.
Figure 2:
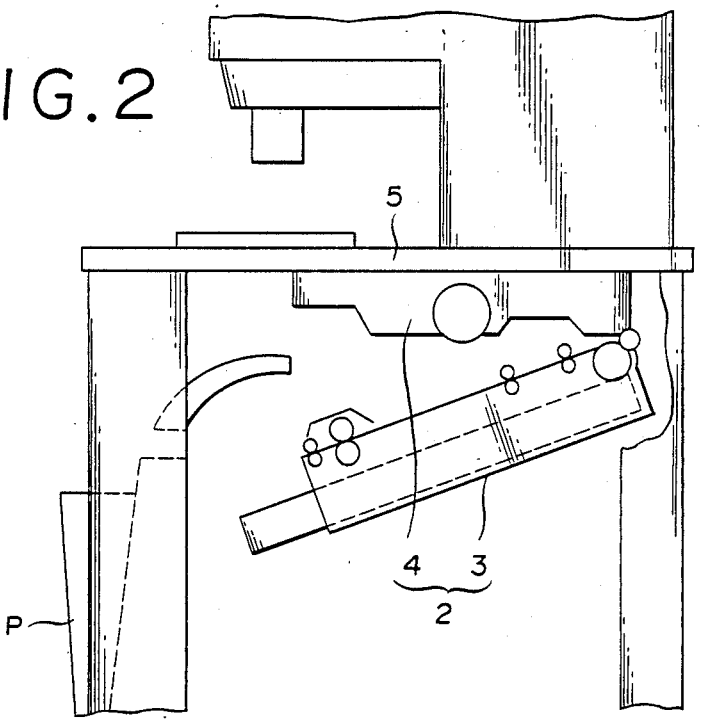
FIG. 2 is a partially omitted side view illustrating another image forming apparatus as further depicting related art of the present invention.

In the reader printer, the light from a light source irradiates the image in a microfilm (not shown) mounted on a carrier disposed on a base plate 5, passes the microfilm, and reaches a projecting lens 6. While the reader printer is in the reader mode, the light from the projecting lens 6 is directed via mirrors, etc. toward a screen 7 disposed in the upper part of the front side of the main body of the apparatus. As the result, the image of the microfilm is projected as magnified on the screen 7 for inspection.

While the reader printer is in the printer mode, the scanning of images past the scanning site or by moving the projecting lens 6 or mirrors, etc. past the scanning site. The light from the projecting lens 6 is directed via mirrors, etc. toward a photosensitive member 8 of the printer part 2. As the result, the image of the microfilm is slit projected on the photosensitive member 8 and transferred to a paper by the conventional process. The paper on which the image has been copied is discharged onto a paper discharge tray 9 which is disposed in the central part of the front side of the main body of the apparatus.

Figure 3:
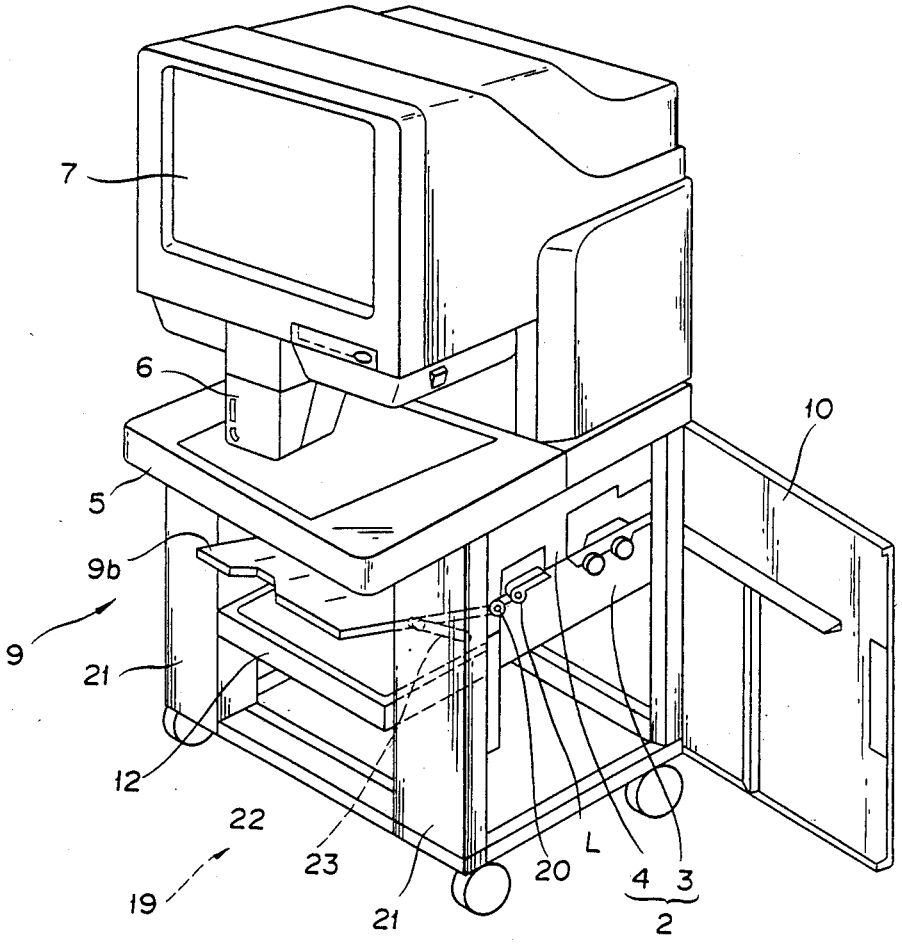
FIG. 3 is a perspective view illustrating a reader printer which embodies th present invention.
Figure 4:
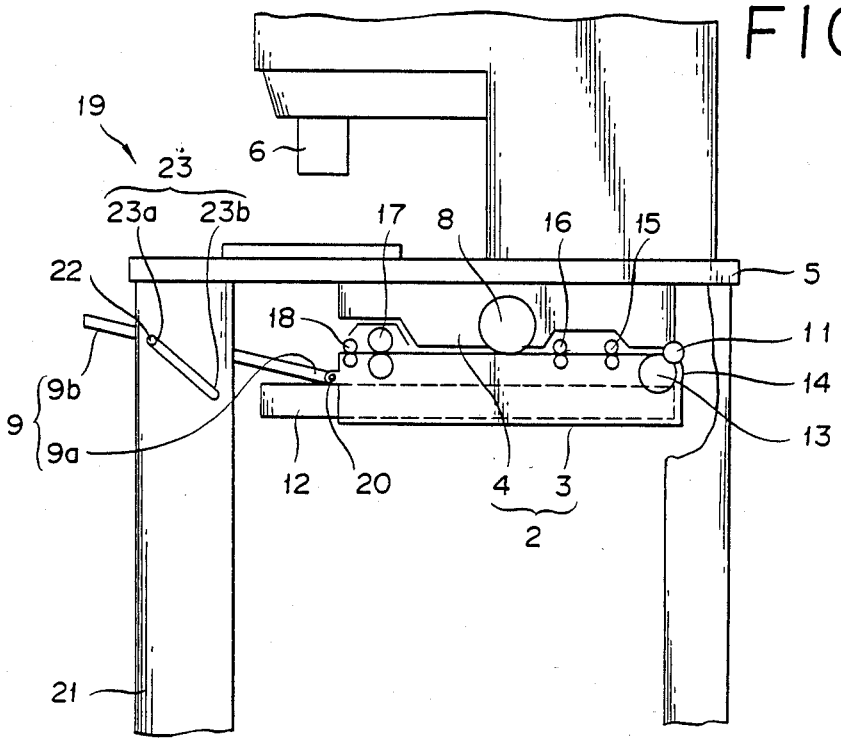
FIG. 4 is a partially omitted side view of the reader printer of FIG. 3 having the printer part thereof in a closed state.
Figure 5:
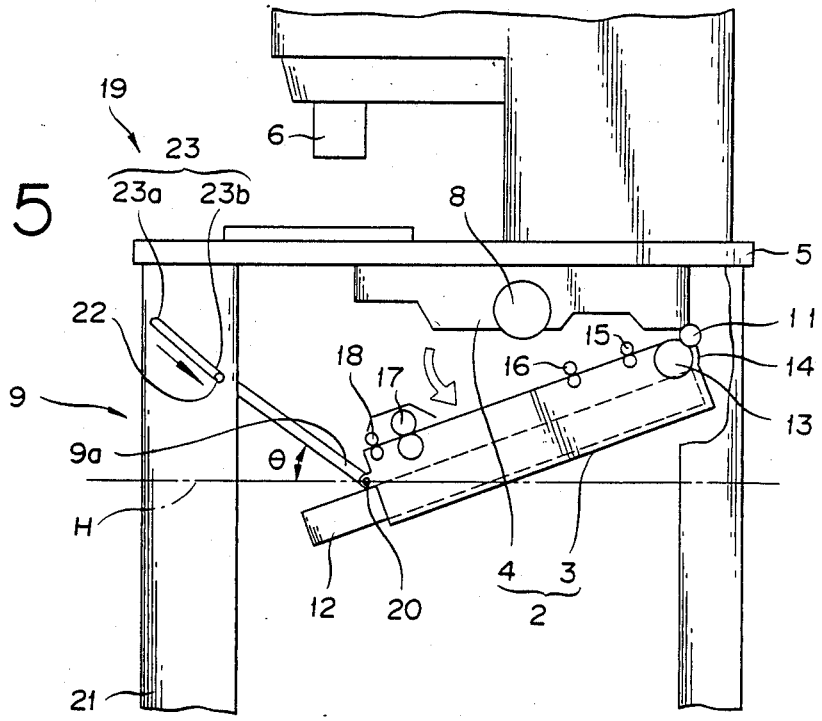
FIG. 5 is a partially omitted side view of the reader printer of FIG. 3 having the printer part in an opened state.

In the lower lateral part of the main body of the appparatus, a cover 10 is disposed so as to be opened and closed with the aid of a vertical shaft as illustrated in FIG. 3. The printer part 2 is incorporated in the main body of the apparatus. The printer part 2 possesses an upper unit 4 fixed to the main body of the apparatus and a lower unit 3 attached at the rear end thereof with the aid of a horizontal open-close shaft 11 to the upper unit 4 so as to be pivoted about the rear end. The upper unit 4 of the printer part 2 is fixed to the lower side of the base plate 5 in the shape of the flat plate disposed in the central part of the main body of the apparatus. An engaging claw and mathced hole (not shown) intended jointly to constitute a locking mechanism are disposed in the proximity of the leading end of the upper unit 4 and the leading end of the lower unit 3. The union of the engaging claw and the hole locks the two units. An open-close lever L illustrated in FIG. 3 is adapted to be operated to break up the union mentioned above and conseqeuntly unlock the two units. FIG. 3 and FIG. 4 illustrate and reader printer in such a state that the lower unit 3 is locked to the upper unit 4 and the printer part 2 is consequently closed. FIG. 5 illustrate the reader printer in such a state that the union of the two units is dissolved and the printer part is consequently opened.

The angle with which the printer part 2 is opened, namely the angle with which the lower unit 3, in consequence of the break up of the union, is allowed to swing downwardly about the open-close shaft 11 under the weight of its own, can be suitably set by means of torsion bar spring (not shown) to be incorporated in the open-close shaft 11, for example. Below the printer part 2, an empty space is formed to permit the downward swing of the lower unit 3.

The lower unit 3 is adapted for a feed paper cassette 12 to be fitted therein inwardly from the front side of the main body of the apparatus. The paper conveyed backwardly from the feed paper cassette 12 by a feed paper roller 13 is turned around by a paper guide 14 and conveyed forwardly. On the lower unit 3, a pair of intermediate rollers 15, a pair of timing rollers 16, a pair of fixing rollers 17, and a pair of discharge paper rollers 18 as arranged in the order mentioned from the rear to the front side. On the upper unit 4, the photosensitive member 8 is disposed as located between the timing rollers 16 and the fixing rollers 17.

The paper paid out of the cassette 12 by the feed paper roller 13 is forwarded via the intermediate rollers 15 and the timing roller 16 to the photosensitive member 8. The surface of the photosensitive member 8 is adapted to form a toner image corresponding to the image on the microfilm. This toner image is then transferred onto the paper. The paper on which the transferred toner image has been deposited is forwarded to the fixing rollers 17 and, after the toner image has been fixed, discharged by the discharge paper roller 18 onto the discharge paper tray 9 to be held therein.

The paper discharge tray 9 is attached at the basal and part 9*a* thereof to the lower unit 3 so as to be freely pivoted about a pin 20. Owing to this arrangement, the paper discharge tray 9 is swung in accordance with the lower unit 3 is swung about the open-close shaft 11. During the course of the pivotal displacement of the paper discharge tray 9, a posture retaining mechanism 19 disposed jointly on the main body of the apparatus and the paper discharge tray 9 enables the leading end part 9*b* of the paper discharge tray 9 on the level higher than that of the basal end part thereof 9*a*. The leading end part 9*b* of the paper discharge tray 9 is located between laterally opposite frame legs 21 jointly constituting the main body of the apparatus and is protruded forwardly from the frame legs 21. Though the paper discharge tray 9 is depicted in the diagram as assuming the shape of a plate, it may be formed in any shape suitable for the intended use.

The posture retaining mechanism 19 is composed of supporting pins 22 protruding laterally from the leading end part 9*b* of the paper discharge tray 9 and linear guide grooves 23 formed aslant in the laterally opposite frame legs 21. The supporting pins 22 are meshed with the guide grooves 23 and are allowed to slide therein as guided thereby. These supporting pins 22 are adapted so as to be held in place by the upper ends 23*a* and the lower ends 23*b* of the guide grooves 23.

When the printer part 2 is in the closed state as illustrated in FIG. 4, the allowable swing of the paper discharge tray 9 is restricted by the contact of the supporting pins 22 with the upper ends 23*a* of the guide grooves 23. In this position, the upper end part 9*b* of the paper discharge tray 9 is retained at a position higher than the basal end part 9*a* thereof, with the result that the paper discharge tray 9 is set at a prescribed angle of inclination.

When the printer part 2 is in the opened state as illustrated in FIG. 5, the supporting pins 22 are retained in place by the lower ends 23*b* of the guide grooves 23 to restrict the allowable swing of the paper discharge tray 9. The position of the lower ends 23*b* is so set that, while the lower unit 3 is in the opened state, the leading end part 9*b* of the paper discharge tray 9 is positioned at a level amply higher than the basal end part 9*a* thereof. In the position in which the supporting pins 22 are in contact with the lower ends 23*b*, therefore, the angle, $\theta$, between the paper discharge tray 9 and the horizontal plane H is not less than 0 degree.

In the reader printer constructed as described above, the printer part 2 is in the closed state and the supporting pins 22 are retained in place by the upper ends 23*a* of the guide grooves 23. While the paper discharge tray 9 is in this state, an inclined posture with the leading end part 9*b* thereof is held at a position slightly higher than the basal end part 9*a* thereof as illustrated in FIG. 4. The paper on which the image of the microfilm has been copied is discharged into the paper discharge tray 9 in the direction from the basal end part 9*a* side thereto the leading end part 9*b* side. The paper, therefore, is not suffered to fall down from the paper discharge tray 9 but is held always on the paper discharge tray 9. The papers thus received in the paper discharge tray are not suffered to be piled up in any irregular state. Since the paper discharge tray 9 is disposed so that the leading end 9*b* thereof is located in the central part of the main body of the apparatus and consequently is positioned closely to the operator's hand, the papers piled in this tray can be easily taken out. Further, the present apparatus has no use for the space which is otherwise required to be formed in the lower part of the front side of the main body of the apparatus for accommodating the discharged papers. This apparatus, therefore, gives rise to a wide empty space in the lower part of the front side of the main body thereof and this wide empty space provides great freedom for the movement of the operator's feet.

When the operator seeks access to the apparatus to make a minor repair for removal of jam or perform a periodical maintenance, he is simply required to manipulate the open-close lever L to release the lock mechanism and open the lower unit 3 pivotally. The supporting pins 22 are slid in the guide grooves 23 as guided thereby from the upper ends 23*a* to the lower ends 23 in concert with the ensuing swing of the lower unit. The paper discharge tray 9 which is joined to the unit 3 is consequently swung about the pins 20 on the basal end part 9*a*. While the supporting pins 23 remain in contact with the lower ends 23*b* of the guide grooves 23, the angle $\theta$ of inclination is retained as illustrated in FIG. 5. In this state, the leading end part 9*b* is positioned at a level amply higher than the basal end part 9*a*. Even in this case, the papers held on the paper discharge tray 9 are prevented infallibly from slipping down from the leading end part 9*b* side.

What is claimed is:

1. In an image forming apparatus possessing a stationary upper unit and a pivotable lower unit adapted to swing downwardly about a pivotal axis attached to said upper unit, the improvement which comprises a paper receiving tray for receiving a paper having the image formed thereon, a basal end part of said paper receiving tray being rotatably attached to the lower unit at the side opposite to a pivotal axis of said lower unit, and a support mechanism for moving the paper receiving tray relative to the movement of said lower unit so that a leading end part of the paper receiving tray is positioned at a level higher than said basal end part thereof.

2. An image forming apparatus according to claim 1, wherein a said support mechanism is composed of guide grooves formed in the main body of the apparatus and supporting pins disposed on said paper receiving tray.

3. A reader printer apparatus having a screen for receiving the light projected through an image on a microfilm disposed on a base plate in the upper part of the main body of said apparatus and having an image forming unit for forming the projected image on a paper incorporated in said main body of said apparatus, which reader printer apparatus is characterized by the fact that said image forming unit possesses an upper unit fixed on said base plate and a lower unit attached to the rear end part of said upper unit so as to be freely pivoted about said rear end part as the center, said apparatus further comprises a paper receiving tray attached pivotally to the leading end part of said lower unit and adapted to accommodate the paper having the image formed thereon in said image forming unit and a slide part disposed in the leading end part of said tray and adapted to slide along a guide groove formed in the main body, and said tray is so adapted that the leading end part thereof is positioned at a level higher than said basal end part thereof when said lower unit is opened.

* * * * *